United States Patent [19]

Fleissner

[11] 4,173,452

[45] Nov. 6, 1979

[54] PROCESS FOR THE CONTINUOUS DYEING OR PRINTING OF LENGTHS OF MATERIAL

[75] Inventor: Hans Fleissner, Riehen, Switzerland

[73] Assignee: Vepa AG, Switzerland

[21] Appl. No.: 788,536

[22] Filed: Apr. 18, 1977

[30] Foreign Application Priority Data

Apr. 17, 1976 [DE] Fed. Rep. of Germany ..... 2617145

[51] Int. Cl.[2] ..... D06B 5/02

[52] U.S. Cl. ..... 8/1 XB; 8/17; 8/147; 8/151; 8/DIG. 16; 68/158

[58] Field of Search ..... 8/151, 1 XB, 147, 17, 8/DIG. 16; 68/158

[56] References Cited

U.S. PATENT DOCUMENTS

| | | | |
|---|---|---|---|
| 2,815,558 | 12/1957 | Bartovics et al. | 8/1 XB |
| 3,469,932 | 9/1969 | Fleissner | 68/158 |
| 3,566,629 | 3/1971 | Fleissner | 68/158 |
| 3,824,814 | 7/1974 | Fleissner | 68/158 |
| 3,828,589 | 8/1974 | Collinge | 68/158 |

FOREIGN PATENT DOCUMENTS

| | | | |
|---|---|---|---|
| 1914145 | 10/1970 | Fed. Rep. of Germany | 8/1 X B |
| 2426479 | 12/1975 | Fed. Rep. of Germany | 8/1 X B |
| 1584107 | 12/1969 | France | 8/1 XB |

OTHER PUBLICATIONS

J.S.D.C. Piece Dyeing of Carpets, A. W. Arbuckle, 10/68, vol. 84, No. 10, pp. 497-501.

*Primary Examiner*—John Kight, III

*Attorney, Agent, or Firm*—Craig and Antonelli

[57] ABSTRACT

A process for the continuous dyeing or printing of lengths of textile material, such as carpet panels having a portion which consists of shrinkable fibers that are set prior to the application of dyes or printing inks includes the step of forcing a hot liquid medium through the length of textile material. An apparatus for effecting this process includes a sieve drum through which the hot liquid medium flows from the inside towards the outside with the material lying on the circumference of the sieve drum.

3 Claims, 1 Drawing Figure

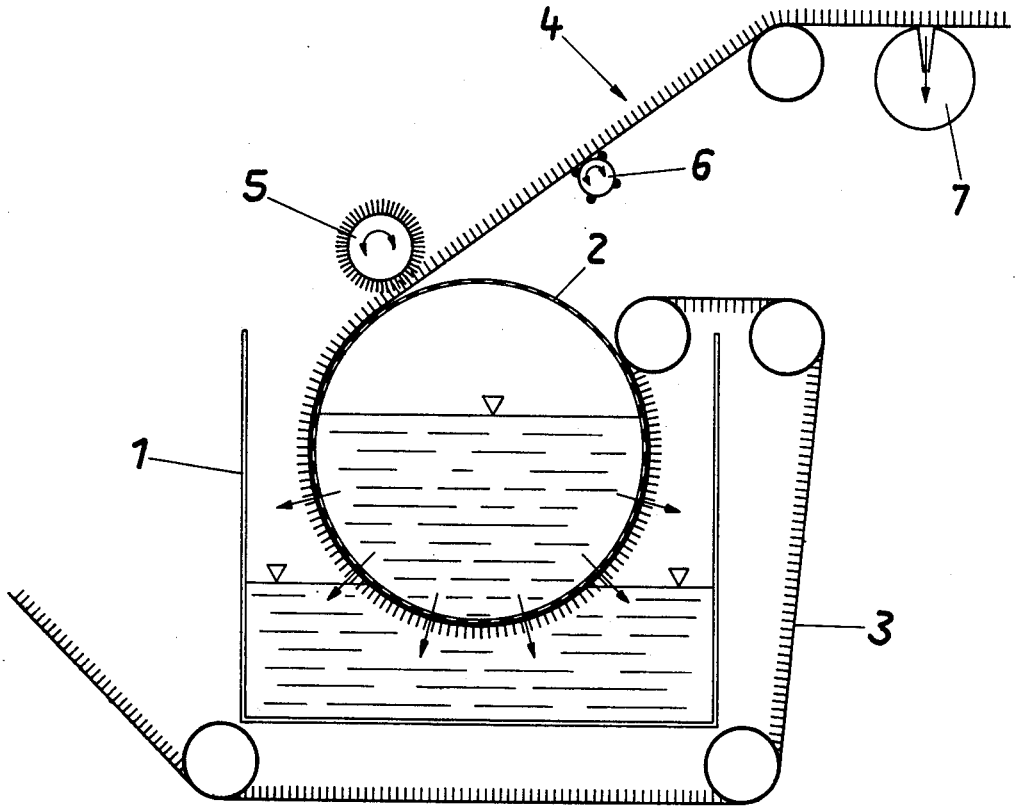
4
5
6
7
2
1
3

PROCESS FOR THE CONTINUOUS DYEING OR PRINTING OF LENGTHS OF MATERIAL

The invention relates to a process for the continuous dyeing or printing of lengths of material, such as particularly velours-type carpet panels, and base and/or pile materials of which consist of shrinkable fibers which are set prior to the application of the dyes or printing ink.

The fibers from which the carpet panel is produced must be set before the panel is printed with dyes, so that the exactly imprinted colored pattern is not altered during the steaming process on account of shrinking fibers. Therefore, it has been proposed to subject the carpet panels prior to the dye application to a heat treatment with the use of hot air in order to set the shrinkable fibers. This procedure proved to be very practical, but is not an optimum method for all of the fibers utilized with respect to its effectiveness.

It is known to treat a length of material with hot water to prepare for a dyeing step, for example in order to soften the plush pile made of polyacrylonitrile fibers. In this way, the plush pile fibers can be uniformly aligned and thereafter also uniformly dyed. Besides, this treatment imparts to the carpet an improved density and a more uniform structure.

Starting with the process of the type set forth hereinabove, the invention is based on the objective of further developing this process advantageously insofar that, during the setting of the shrinkable fibers, the pile fibers of the carpet panel, of the woven fabric, or of the knitted fabric are simultaneously fluffed up, the fibers are aligned and also opened to subject all of the fibers to a uniform treatment.

In order to attain the posed objective, the invention provides that a hot, liquid medium is forced through the web of material. Suitably, the liquid is to flow from the inside toward the outside, i.e. in the direction of the tips of the pile, whereby the pile is aligned and spread. An advantageous device for conducting the process is the sieve drum, the material, if it is pile material, being placed on the circumference of the drum with the rear side of the material. The outwardly oriented pile is opened up while lying on the curved supporting surface of the sieve drum shell and during this step it is subjected to the flow of the hot water from the inside toward the outside and thus is urged to stand upright. The hot water will produce the shrinkage and the nap [tuft], so that full surface is attained with only a small amount of material being utilized.

Subsequently to the treatment of the length of material on the sieve drum device, the length of material is to be guided so that it is no longer placed under pressure on the face side until the cooling step. For this reason, an air duct follows the sieve drum device, this duct having elements which support the length of material solely on its back. In this zone, shaker or beater rolls can be provided, suitably also a suction removal means in order to dewater the length of material at least partially.

The drawing illustrates one embodiment of an apparatus for conducting the process of this invention.

The drawing shows a sieve drum washing machine with a sieve drum 2 rotatably mounted in a container 1; the length 3 of material loops around the drum on the underside. The length of material is guided so that the pile side is oriented toward the outside, i.e. the carrier layer lies on the sieve drum shell. The hot water serving for the treatment is provided at the end face of the sieve drum above the container 1 so that the liquid introduced into the sieve drum can freely flow toward the outside i.e. the level difference is present between the inside and the outside as illustrated. Consequently, the hot water introduced into the sieve drum will flow automatically on account of gravity uniformly over the working width through the sieve drum wall and through the length 3 of material and will set the pile upright and fluff same during this process.

After the treatment, the length of material, guided in an air duct 4, must be associated with brushing or beating rolls 5, 6. After the cooling zone, a suction removal means 7 is provided to drain the largest portion of the water, which has been cooled off at that point. The suction removal means is likewise provided on the back of the length of material.

What is claimed is:

1. A process for the continuous dyeing or printing of a length of textile material, particularly a velour-type carpet panel having a base side and a pile side, the materials forming the base and/or pile sides including shrinkable fibers which are set prior to the application of dyes or printing inks, which comprises transporting the length of material with the pile side under pressure to a sieve drum having a perforated circumferential support surface, guiding the length of material onto the circumferential support surface of the sieve drum with the backside of the textile material lying on the support surface, forcing a hot liquid medium from within said sieve drum outwardly through the length of material in the direction of tips of the pile whereby the pile is spread and made upright during the flow of the liquid medium therethrough and the shrinkable fibers are set by said hot liquid medium with the pile in the spread and upright state and thereafter transporting the length of material with the pile surface not under pressure to and through a cooling zone to cool the length of material and the hot liquid contained therein.

2. The process of claim 1, further comprising brushing the pile side of the length of textile material upon entry into said cooling zone and thereafter applying a suction to the base side of the length of textile material to drain cool liquid medium from said length of material.

3. The process of claim 1, wherein said cooling zone is provided by an air duct, said process further comprising contacting said length of textile material with air within said air duct.

* * * * *